United States Patent [19]

Holm

[11] 4,440,182

[45] Apr. 3, 1984

[54] SANDER FOR ARTIFICIAL NAILS

[76] Inventor: Harold K. Holm, 410 W. Harvey, Santa Ana, Calif. 92707

[21] Appl. No.: 477,145

[22] Filed: Mar. 21, 1983

[51] Int. Cl.[3] ..... A45D 29/04

[52] U.S. Cl. ..... 132/75.6; 132/73.6; 132/75.8

[58] Field of Search ..... 132/75.6, 73.6, 75.8, 132/76.4

[56] References Cited

U.S. PATENT DOCUMENTS 1,115,337 10/1914 Rossetter ..... 132/75.8

1,472,876 11/1923 Larrus et al. ..... 132/73.6

3,311,117 3/1967 Thompson ..... 132/73.6

*Primary Examiner*—Gregory E. McNeill

*Attorney, Agent, or Firm*—Grover A. Frater

[57] ABSTRACT

A fingernail shaping instrument in the form of an orbital sander having a head containing an eccentrically mounted weight, a drive unit containing a drive motor, a coiled tilting spring interconnecting the head and drive unit such as to permit orbital motion of the head relative to the drive unit. A separate coiled drive spring interconnects the motor and the weight.

19 Claims, 8 Drawing Figures

SANDER FOR ARTIFICIAL NAILS

TECHNICAL FIELD

This invention relates to apparatus in the form of an improved orbital sanding instrument which is especially useful for processing artificial fingernails.

BACKGROUND ART

Among the developments of chemistry are polymers that have been applied by the cosmetics industry to the formation of artificial fingernails. These new materials serve as adhesives for bonding plastic extensions to a wearer's fingernails. They are strong and tough and serve both as adhesives and as fillers. Some are capable of being used to build up an extension without anything more. A shield is placed under the nail so that it serves as a form for the lower surface of an extension. The nail material is painted on to the end of the user's nail and over the shield. Drying is rapid, and the result is a hard, tough, properly flexible extension.

However, the qualities that make these materials serve as fillers serve also to produce an extension of uneven thickness and length. The dried material needs to be shaped and then the hardness and toughness are disadvantages. Smoothing and shaping the new nail requires a file or sandpaper or, more usually, a grinding tool.

The underside of the new nail is easily smoothed and polished with the side of a small rotary grinder. A simple cylindrical grinding wheel is adequate because the underside of the nail curves around such a wheel. But smoothing the upper surface and trimming and shaping the end is not so easily accomplished. Here, the nail curves the wrong way and it is more difficult to smooth the edges at the side of the nail without injuring the flesh of the finger.

The difficulty in smoothing the nail, especially on the right hand of a right-handed user, or the left hand of a left-handed user, has effectively prevented women from self treatment to rebuild and extend nails, despite the ease with which the new materials can be used to build up a nail extension.

Treatment is now largely reserved to professionals. That has not diminished the need for a better smoothing apparatus and technique even in the hand of a professional, a conventional grinding tool curves oppositely from nail curvature. However, the professional is required to work fast and is expected not to grind into a client's finger in the process. The smoothing process is primarily mechanical—filing and/or grinding. To do that rapidly generates heat. The craft and hobby kit grinders that have been the manicurists' standard tool are used in a way that concentrates rather than distributes the heat. The result is often discomfort and it has been common practice to keep a container of cooling water at the manicurist's work place to remedy misjudgments. Grinding at the edge of a rotating wheel requires a relatively high degree of skill both in guiding the tool over the work area and in controlling the pressure with which the tool is applied to the nail. Grinding at the side of such a rotating wheel requires even more skill because the tendency for the tool to "walk" is increased. The invention provides an effective and practical solution to these problems.

DISCLOSURE OF THE INVENTION

An object of the invention is to provide an improved tool for polishing, smoothing and shaping fingernails, both artificial and real.

While the invention is particularly useful for manicuring nails, it is applicable to many more tasks. One of the objects of the invention is to provide an improved orbital motion tool.

The invention discards the conventional rotational motion of the grinding surface. Instead, an "orbiting" motion is employed. The grinding surface is flat. Instead of spinning the grinding surface on an axis, the entire surface is orbited about the axis.

The orbital motion permits use of a concave cylinder sanding surface. Shaped thus, the abrating or sanding action is distributed over a greater area. The smoothing action is facilitated and heating is distributed over a wider area and, of course, is less at any particular point.

While the concave cylinder sanding surface is an advantage, it must be oriented properly in use. The invention provides a novel means for mounting the sanding surface and for driving it in orbital motion from a hand-held drive section. The drive section is generally cylindrical. In the manicurist's version, it is small enough and is shaped to be held like a pencil. The on-off switch is mounted in the eraser position, and the sanding surface is carried on a sanding head. The latter is resiliently mounted on the drive section and occupies the position of the lead of the pencil. The spring mounting is special. Drive action is transmitted to the sanding head through a resilient coupling that exhibits one spring rate. The head, whose sanding surface ordinarily lies in a plane perpendicular to the axis of the drive section, is carried on the drive section by a resilient mounting that permits tilting of the head and sanding surface, and which exhibits a different spring rate.

The resilient coupling permits the head to follow the nail contour as the drive section is manipulated like a pencil. The resilient coupling obviates the need for the concave cylindrical sanding surface shape, although in some applications it is preferred to combine those features.

In the preferred form, the on-off switch is one that can be actuated to both states by motion along the axis of the drive section toward the drive section. Thus arranged, the manicurist can turn power on-and-off while holding the unit in one hand by pressing the switch against her/his body or other surface for true one hand operation.

Orbital sanders have a tendency to orbit the user as much as the sanding surface. In the invention, the head is connected to the driving unit through a resilient coupling which, in preferred form, is a coiled spring. The eccentrically mounted weight is driven by a motor in the drive unit through a second resilient coupler which, in preferred form, is a coiled spring within the first spring and oppositely coiled. The result is an orbital motion with only minimum vibration being transmitted to the drive unit, which serves as a handle.

These and other advantages of the invention will become apparent upon a reading of the detailed description of one embodiment that follows. In that connection, it is to be understood that other embodiments are possible and that the scope of the invention is to be measured not by that embodiment but by the scope of the appended claims.

DESCRIPTION OF THE PREFERRED EMBODIMENT

Figure 1:
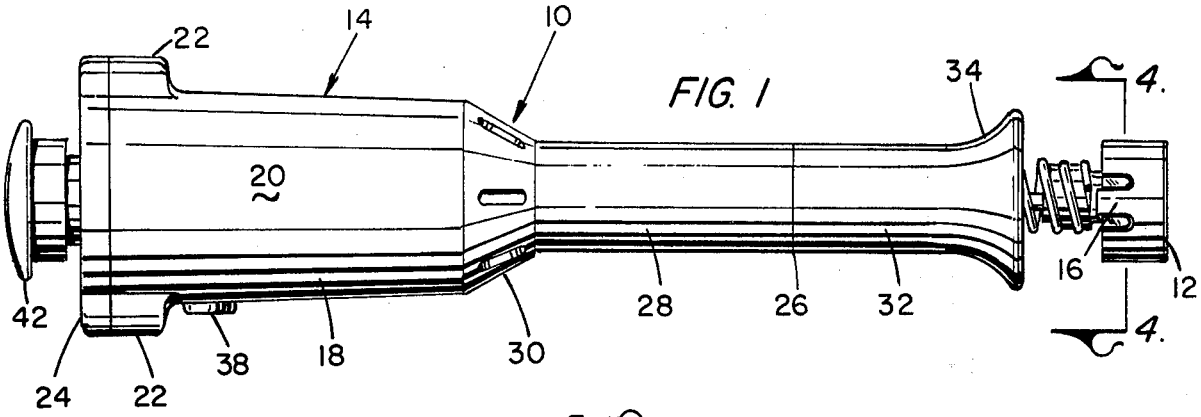
FIG. 1 is a view in side elevation of a manicurist's nail finishing instrument according to the invention.
Figure 2:
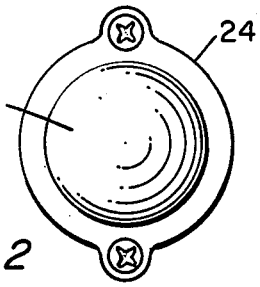
FIG. 2 is a view in elevation of the switch end of the instrument of FIG. 1.
Figure 3:
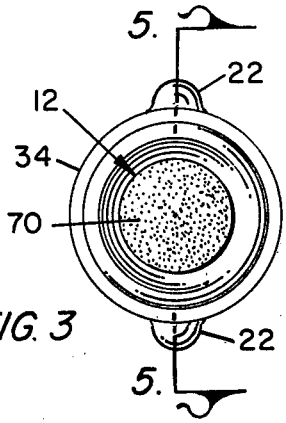
FIG. 3 is a view in elevation of the sanding head end of the instrument.

The preferred embodiment of the invention is shown in FIGS. 1 through 6 of the drawing. The instrument which is generally designated 10 includes a head section 12, a driving section 14, and a resilient interconnection section 16 by which the head section is connected with the driving section. The exterior is best shown in FIG. 1. The driving section includes a housing 18. The rearward portion 20 of the housing is generally cylindrical except at its rearward end where a pair of diametrically positioned side extensions 22 are shown. Those extensions cooperate with similar extensions of the end cover 24. A pair of machine screws extend, one through each extension of the cover, into threaded openings in the extensions 22 of the body 18. The forward end of the body is also generally cylindrical, although it has reduced diameter. That forward portion is generally designated 26. It is divided into two sections to facilitate assembly of the internal elements. The rearward portion of that reduced diameter section is numbered 28 and it is integrally formed with the cylindrical portion 20. Portions 28 and 20 are joined by a conical section 30 in which a number of airflow openings are formed.

The forward portion 32 of the reduced diameter section is flared outwardly to larger diameter at its forward end. For identification, that flared region has been given the reference numeral 34.

Figure 5:
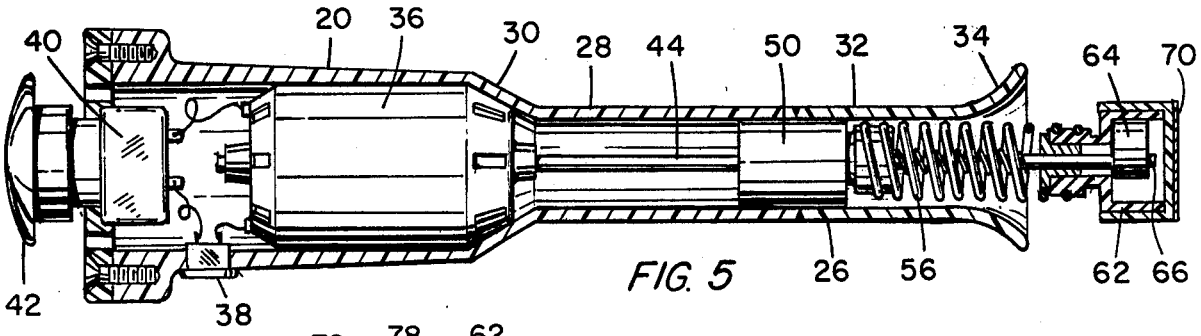
FIG. 5 is a cross-sectional view taken on line 5—5 of FIG. 3, the internal parts being shown in elevation.

The driving section includes a motor 36 which may be seen in the cross-sectional view of FIG. 5. Electrical power for the motor is supplied from an external source through a jack 38. As best shown in FIG. 5, the motor 36 is connected in series with a control switch 40 across the two terminals of the power input jack 38. This embodiment employs a "push-push switch" which alternately opens and closes in response to pressure applied against the actuator 42. In this embodiment of the invention, the instrument is intended to be held like a pencil by grasping it at the reduced diameter section 26 of the driving section 14 with the fingers adjacent the flared region 34. In an analogy with a pencil, the head section 12 would correspond to the pencil lead.

Except for the extensions 22 and the presence of the power inlet jack 38, the driving section of the instrument is substantially symmetrical about its central axis. The shaft 44 of the motor extends forwardly from the motor on that axis along the axis of the forward section 26.

Figure 6:
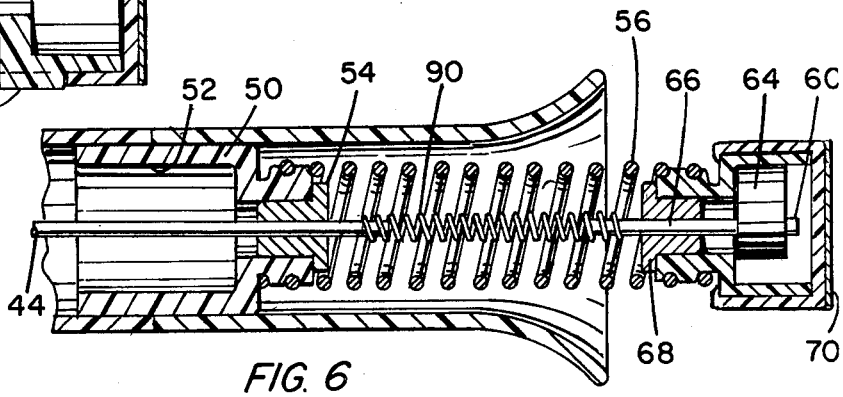
FIG. 6 is a cross-sectional view of the forward portion of the instrument taken on line 6—6 of FIG. 3, some of the internal parts being shown in section and others being shown in elevation.

As best shown in FIG. 6, the motor shaft 44 extends through a member 50 which serves several purposes. It has a generally cylindrical, hollow rearward section 52 which is press-fitted into the adjacent ends of sections 28 and 32 of the smaller diameter section 26 of the driving unit. The forward end of that element 50 has reduced inside and outside diameter at its forward end. A brass fitting 54 is inserted into the smaller diameter end of the element 50 where it serves as a bearing for the forward end of motor shaft 44. The exterior of that reduced diameter forward end of element 50 is formed with circumferential grooves. The several turns of the rearward end of a tilting spring 56 are turned onto the reduced diameter forward end of member 50 so that those turns fit within the grooves of that member to complete a firm connection between the rearward end of the spring 56 and, through the member 50, the drive section 14 of the instrument.

The tilting spring 56 is one of two springs which extend from the driving section 14 of the instrument to the head section 12.

In this embodiment, the head section comprises six elements. They are a cup 60, a cap 62, an eccentrically mounted weight 64, a centrally mounted eccentric shaft 66, a bearing 68 which is press-fitted into an opening at the bottom of the cup member 60 and serves as a bearing for the shaft 66, and, finally, a layer 70 of abrasive material which is bonded to the forward face of the cover 62.

Figure 4:
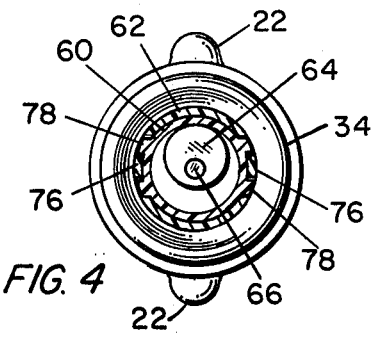
FIG. 4 is a cross-sectional view taken on line 4—4 of FIG. 1.

In the preferred embodiment, the cap 62 is removable from the cup 60 and the cap has its side walls notched to form a finger at diametric points of its side wall. The lower end of each finger is shaped to form the catch which fits under the bottom of the cup and serves to retain the cap in place. The clips are sufficiently wide to accommodate guide ribs formed on the external surface of the cup. That construction can be understood by a comparison of FIGS. 4, 5, 7 and 8. The cap shown in FIG. 8 is a modification in that its forward face has a concave cylindrical shape, whereas the cover 62 of the other figures is flat. Except for that, the constructions are the same. In FIG. 4, the fingers of the cap are identified by the reference numeral 76, and the guide ribs of the cup are identfied by the reference numeral 78. In FIG. 8, the cup 60 is unchanged and its parts are identified by the same reference numerals as are employed in the other figures. The cap 80 has a finger 82 which is defined by the cutaway sections 84 one of which fits over a guide rib 78.

Figure 7:
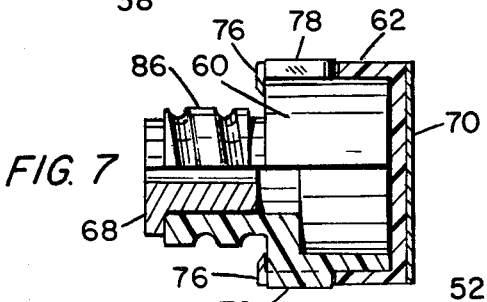
FIG. 7 is a partly cross-sectioned view of the head of the preferred embodiment.
Figure 8:
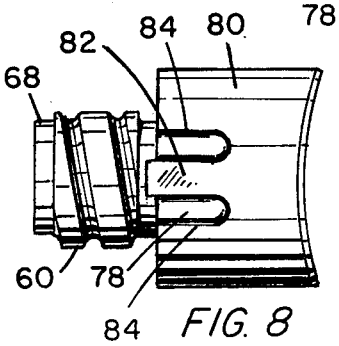
FIG. 8 is a side view of a sanding head whose surface has concave prismatic shape.

As best shown in FIGS. 7 and 8, the rearward or bottom end of the cup is provided with a rearwardly extension 86 which has reduced diameter, and the exterior of which is provided with grooves to accommodate the forward end of the tilting spring 56. It may be seen in FIG. 5 and 6 that the forward end of the tilting spring is threaded onto the grooves of the cup extension 86 so that a connection is completed through the spring from the drive section 14 to the head section 12.

As best shown in FIG. 6, a drive spring 90 which is mounted concentrically within the tilting spring 56 is coiled. At its rearward end that spring is wrapped around the forward end of the motor drive shaft 44. At its forward end the drive spring 90 is wrapped around and fixed to the shaft 66 on which the eccentric weight is mounted.

When power is applied to the motor, shaft 44 rotates, rotating the spring 90 which, in turn, rotates shaft 66 and the eccentric weight 64. The cup and the cover are prevented from rotating about the axis of the shaft by the tilt spring 56. Instead, the head orbits about the axis of the shaft 44. To accommodate that orbital movement, the spring 56 tilts in the direction, at any instant, from the axis of shaft 44 toward the center of gravity of the weight 64. As a consequence, rotation of the weight results in a tilting of the spring 56, and a tilting of the drive spring 90, in every radial direction with each turn of the weight. The spring rate of the springs 90 and 56 are different so that any tendency to oscillatory motion of the driving unit 14 in sympathy with orbital movement of the head is minimized. That effect of minimizing vibration at the handle portion of the instrument is aided by the fact that the two springs are wound in opposite direction.

It will be apparent that, when using the instrument to smooth natural and artificial nail material, the smoothing or abrating action is distributed over a wider area of the nail if that smoothing and abrasive action occurs at the forward face of the instrument head or "grinding wheel" than if the smoothing and abrating action were accomplished by the side edge of the head or grinding wheel. When the head or grinding wheel rotates and spins about its central axis, the head or grinding wheel will tend to "walk" while the tool is in use, and the degree of that "walking" increases with the amount of pressure that is applied by the tool on the nail or other work piece. That walking action is eliminated when orbital motion is used.

Because of the two-part resilient interconnection between the head and the driving unit, vibration can be virtually eliminated from the driving unit which is the hand-held portion of the instrument. That resilient interconnection can have several forms. For example, it could be made of concentrically arranged tubes of elastomeric material. Certainly that form, and other forms that have the effect of driving the head to orbital motion while permitting tilting, can be used. The springs are preferred, especially when the springs are wound in opposite direction as in this preferred embodiment.

One of the advantages of the tilting spring arrangement is that the head can be tilted away from the axis of the motor drive 44 as a consequence of interaction between the head and the work surface. That means that the head tends to follow the curvature of the nail while the nail is being shaped, even though the handle itself is not tilted in corresponding degree.

To minimize the degree in which tilting of the handle is required in shaping a fingernail, the forward face of the head, that is, the forward face of the cap and of its abrasive covering, can be curved as shown in FIG. 8. The curve is concave-cylindrical as that term is employed in the lens making art.

Although I have shown and described certain specific embodiments of my invention, I am fully aware that many modifications thereof are possible. My invention, therefore, is not to be restricted except insofar as is necessitated by the prior art.

What is claimed is:

1. A fingernail shaping instrument comprising:

a sanding head;

a head driving unit;

resilient means for mounting the sanding head on the head driving unit such that the head is movable with the head driving unit and is capable of being tilted relative to a line extending between the head and head driving unit; and means for moving said head orbitally about said line.

2. The invention defined in claim 1 in which said head is mounted at the end of a coiled tilting spring the other end of which is mounted on said driving unit;

the axis of the spring lying on said line when the spring is relaxed and the spring being free to bend to carry the head away from said line in every radial direction from said line.

3. The invention defined in claim 2 in which said head comprises an eccentrically mounted weight rotatable about the axis of said spring; and driving means carried by said driving unit for rotating said weight about said axis of said spring.

4. The invention defined in claim 3 in which said driving means comprises an electric motor, and a resilient driving connection between said motor and said eccentrically mounted weight.

5. The invention defined in claim 4 in which said resilient driving connection is formed by a coiled drive spring the axis of which lies substantially on the axis of said coiled tilting spring.

6. The invention defined in claim 5 in which said springs are oppositely coiled.

7. The invention defined in claim 6 in which said driving unit comprises a housing containing said motor, the housing comprising a cylindrical tubular extension surrounding said tilting spring.

8. The invention defined in claim 7 in which said tubular extension is flared outwardly to greater diameter at its end in the region of said head.

9. The invention defined in claim 5 which further comprises a push actuated switch mounted at the end of said driving unit opposite said head and operable to energize and deenergize said drive motor by actuation in the direction toward said head.

10. The invention defined in claim 5 in which said head is hollow, said weight being disposed within the hollow and mounted on an eccentric shaft, a bearing mounted centrally in a wall of said head toward said driving unit and said shaft extending through said bearing.

11. The invention defined in claim 10 in which said drive spring is connected at one end to said eccentric shaft and at the other end to the shaft of said motor.

12. The invention defined in claim 10 in which the side of said head away from said driving unit is substantially flat and lies in a plane perpendicular to the axis of said spring and said eccentric shaft.

13. The invention defined in claim 12 in which the side of said head away from the driving unit lies in a plane perpendicular to the axis of said eccentric shaft and is concave-cylindrical.

14. An orbital sander comprising:

a handle section comprising a drive motor having a rotatable output shaft;

a sanding head having a sanding face on one side and an eccentric driving shaft extending from the opposite side;

a first resilient means interconnecting the motor shaft and the eccentric shaft; and a second resilient means for interconnecting the sanding head and handle section while permitting the drive spring to flex.

15. The invention defined in claim 14 which further comprises a weight disposed in said head eccentrically mounted on said eccentric shaft.

16. The invention defined in claim 15 in which said first resilient means comprises a coiled spring.

17. The invention defined in claim 15 in which said second resilient means comprises a coiled spring.

18. The invention defined in claim 15 in which said first and said second resilient means comprises a coiled drive spring and a coiled tilting spring.

19. The invention defined in claim 18 in which said coiled drive spring and said coiled tilting spring are arranged on a common axis with the drive spring within the tilting spring.

* * * * *